United States Patent [19]

Scott

[11] 4,403,824

[45] Sep. 13, 1983

[54] PLUG CONNECTOR AND RECEPTACLE

[75] Inventor: Ernest R. Scott, Mayfield Heights, Ohio

[73] Assignee: The Scott & Fetzer Company, Westlake, Ohio

[21] Appl. No.: 239,502

[22] Filed: Mar. 2, 1981

[51] Int. Cl.[3] ..... H01R 13/64

[52] U.S. Cl. ..... 339/186 R

[58] Field of Search ..... 339/184, 186

[56] References Cited

U.S. PATENT DOCUMENTS 1,157,026 10/1915 Meschenmoser ..... 339/186 R

FOREIGN PATENT DOCUMENTS 2517291 10/1976 Fed. Rep. of Germany ... 339/186 R

*Primary Examiner*—Neil Abrams

*Attorney, Agent, or Firm*—Pearne, Gordon, Sessions, McCoy, Granger & Tilberry

[57] ABSTRACT

A female electrical connector which has a cross section distinguished by a deep keyway allowing it to be accepted by a complementarily shaped appliance receptacle having a discriminator blade which interfits with the keyway but which rejects other connector arrangements. The disclosed connector discourages possibly unsafe consumer practices in cord set use while affording a degree of manufacturing standardization with other connector and receptacle arrangements.

3 Claims, 6 Drawing Figures

PLUG CONNECTOR AND RECEPTACLE

BACKGROUND OF THE INVENTION

The invention relates to detachable cord sets for electrical appliances and in particular to a special female connector mating with a complementary receptacle on such appliance.

PRIOR ART

Detachable cord sets for electrical appliances have advantages over permanently attached cord sets in situations involving handling, storage, and replacement of the cord sets. Recently, Underwriters' Laboratories has recognized a potential problem that possible dangers could arise where a detachable cord set was used with an appliance other than its originally intended appliance and be subjected to excessive currents. It is therefore desirable that a detachable cord set not be compatible with standard male plugs commonly used in North America. There is also a danger that a user of an electrical appliance will substitute a replacement cord which might be of insufficient current rating on an electrical appliance where that appliance utilizes a connector receptacle which has its electrical blade geometry complementary to such male plugs, U.S. Pat. No. 3,843,224 to Gerke, Jr. et al. recognizes the potential problem of mismatched current capacity in detachable cord set and appliance combinations and has proposed different connector profiles corresponding to differences in current capacity of cord sets so as to permit limited compatibility and interchangeability between such cord sets and appliances.

SUMMARY OF THE INVENTION

The invention pertains to a detachable cord set having a female connector compatible with an appliance receptacle that prevents possibly unsafe use of ordinary household extension cord sets. The disclosed configuration of the connector advantageously permits the utilization of parts and tooling in common with standard European connector designs, thereby saving manufacturing and inventory costs. On the other hand, the disclosed cord set prevents its use as a universal extension cord by virtue of its incompatibility with appliances, tools, and other electrical equipment incorporating the connector-type standard in North America. Although it utilizes certain European-type structures, the disclosed connector cooperates with a receptacle with excludes even standard European cord sets which could otherwise mislead a user to conclude that by such use the appliance will be grounded by a center terminal. Stated in other words, the disclosed cord set connector provides the important features of (1) a high degree of manufacturing standardization, (2) lessened risk of the use of a substandard replacement cord set, and (3) lessened risk of the cord set being improperly used as a utility extension cord.

As disclosed, the cord set connector is female in form, providing on an end face a pair of spaced recesses on opposite sides of a plane of symmetry and a keyway cntered on such plane. The keyway is a slot extending laterally from within a plane common to the recesses and longitudinally from the end face to the midsection of the body of the connector. The keyway is adapted to accept a compatibly shaped key blade in a receptacle as the connector is inserted into the receptacle. The key blade obstructs all known connectors in common use from being coupled in the receptacle. Ideally, the key blade is analogous to the center grounding prong of conventional plugs so that, owing to its size and location, it can be adapted in existing tooling. In a particularly advantageous manner, the key blade can be provided as an element integral with an insulator body ordinarily disposed between the current carrying prongs of the receptacle. When provided in this manner, the key blade requires no separate fabrication, assembly, or retention in the receptacle.

DESCRIPTION OF THE PREFERRED EMBODIMENT

Figure 1:
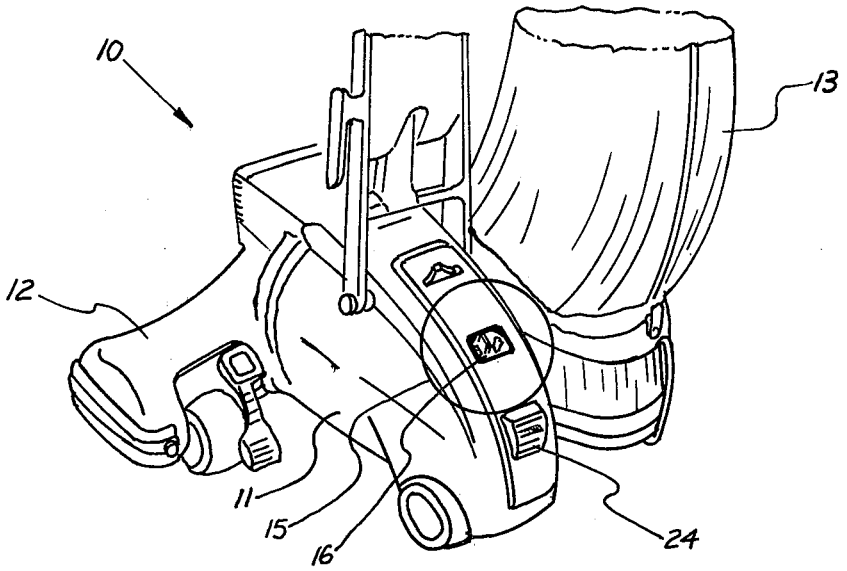
FIG. 1 is a partial, rear perspective view of an electric vacuum cleaner appliance embodying features of the present invention.

Referring now to the drawings, and in particular to FIG. 1, there is shown an electrically operated appliance 10 in the form of a domestic vacuum cleaner. The vacuum cleaner 10 is generally conventional in construction other than in respects detailed below. The vacuum cleaner includes a housing 11 of metal or other structural material in which is mounted an electric motor which operates a vacuum fan and a rotary brush, for example. Vacuumed material collected under a nozzle 12 is received in an upright bag 13. It will be understood that the motor in the illustrated appliance 10 is of the double-insulated type. In a rear section of the housing 11 outlined by a reference circle 15 in FIG. 1, the housing is provided with a generally rectangular aperture 16. A foot switch housing 18 partially shown in FIG. 2 includes a rectangular projection 19 sized to substantially close off the vacuum cleaner housing aperture 16 when the foot switch housing is mounted in the cleaner housing 11. The foot switch housing 18 is preferably formed of electrically insulating material and is ideally fabricated of injection molded plastic. The rectangular projection 19 of the foot switch housing 18 forms part of a connector receptacle generally designated at 22 which includes a cavity 23. A foot pedal 24 projecting through an associated aperture in the appliance housing 11 operates a foot switch which controls electrical continuity between a pair of electrical connectors in the form of flat blade prongs 27 within the foot switch receptacle cavity 23 and the vacuum motor, as well as other electrically operated accessories. The prongs 27 are anchored in the body of the foot switch housing 18 in a known manner. An insert 31 is disposed between the blades 27 and helps retain them in their assembled position. The insert 31 is fixed in the bottom of the receptacle cavity 23, also in a known manner. The insert 31 most clearly shown in FIG. 2*a* is conveniently fabricated as an injection molded part of nylon, Delrin or other suitable plastic electrically insulating material. The insert 31 includes an integral flat blade 32. This insert blade 32 lies in a plane parallel to the electrical blades 27 and extends laterally from the perimeter of the cavity 23 to or adjacent to a plane common to these latter blades. The insert 31 is assembled and retained on the switch housing 18 by sliding it in associated grooves 35 of respective halves 18*a*, 18*b* of the switch housing, which in turn are held together by a suitable bolt, rivet, etc.

Figure 2:
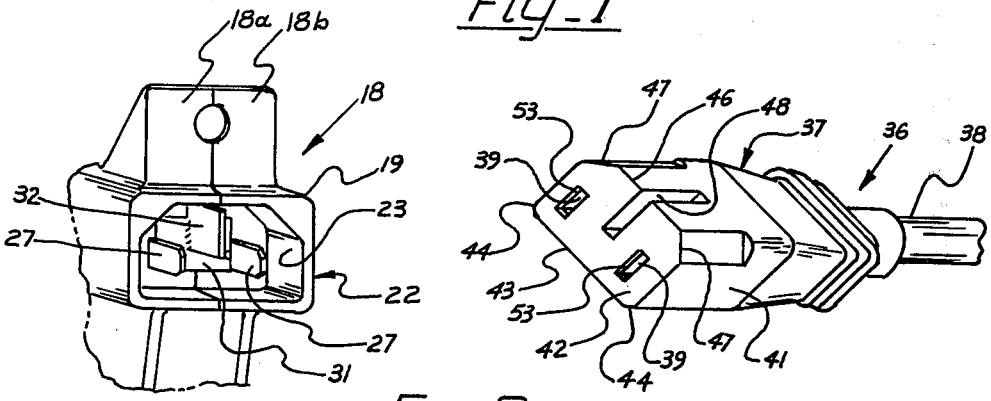
FIG. 2 is a partial perspective view of an appliance receptacle and a mating cord set constructed in accordance with the present invention.
Figure 2A:
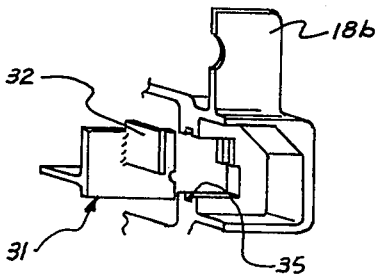
FIG. 2*a* is an exploded, fragmentary, perspective view of elements of the appliance receptacle.
Figure 2B:
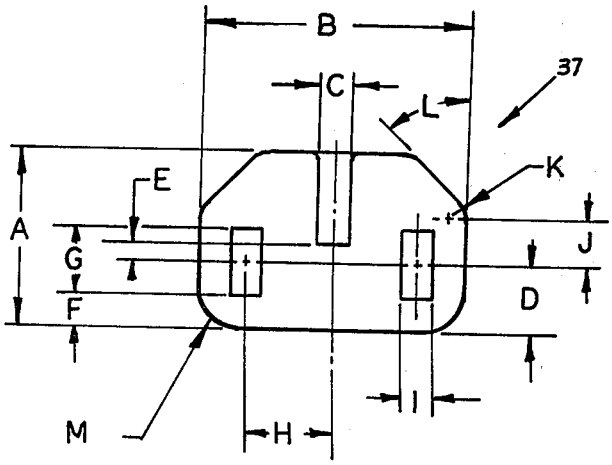
FIG. 2*b* is a view of the end face of the cord connector of FIG. 2 on a somewhat enlarged scale.
Figure 3:
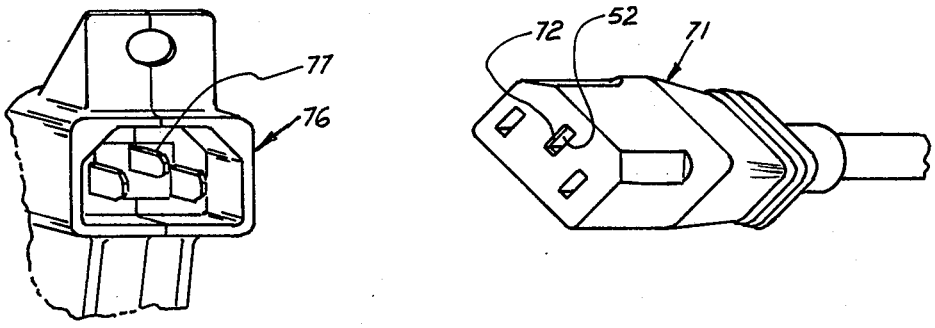
(PRIOR ART) Fig 3
FIG. 3 is a partial perspective view of an appliance receptacle and a mating cord set in one form of the prior art.

A detachable cord set 36, partially illustrated in FIG. 2, is constructed in accordance with the invention and is arranged to cooperate with the electrical receptacle 22 of the appliance 10. The cord set 36 includes a female type connector body 37. The connector body 37 is preferably made of plastic or other electrically insulating material and is formed in place by known molding techniques on a flexible electric cord 38. Encased within the cord 38 are a pair of separately insulated electrically conducting wires. As is customary, the wires of the cord 38 are terminated with electrical contactor blades 39. The end of the cord 38 not shown in FIG. 2 is fitted with a conventional male connector which fits into the type of convenience outlet or socket normally used in households in the United States. A lead section 41 of the connector 37 which is received in the receptacle cavity 23, as discussed later, is a prismatic projection of its lead end face 42. The lead or engagement end face 42, shown most clearly in FIG. 2*b*, has a perimetric profile that is primarily rectangular, but which has its corners modified for purposes of orientation. The corners associated with one long side 43 of the end face perimeter are rounded at 44, while the corners associated with the other long side 46 are beveled at 45-degree angles at 47. The long side 46 is interrupted at its midpoint by the entrance to a keyway 48 which extends longitudinally of the connector body 37 substantially along the full length of the lead section 41. The geometry of the lead section 41 is analogous to a European style connector known in the art as the CEE-22 connector 71 which includes a ground wire and associated contact and is shown in FIG. 3. The following Table sets forth nominal dimensions for the designated parameters of the connector body 37 indicated in FIG. 2*b*, which is substantially drawn to proportion.

| | |
|---|---|
| A | .612 inches |
| B | .895 inches |
| C | .104 inches |
| D | .213 inches |
| E | .054 inches |
| F | .110 inches typical |
| G | .207 inches typical |
| H | .275 inches typical |
| I | .104 inches typical |
| J | .184 inches typical |
| K | .120 inches radius typical |
| L | 45° typical |
| M | .13 inches radius typical |

A critical departure in the structure of the present connector body 37 from the CEE-22 type is a conversion of a center grounding recess 72, a closed boundary aperture in the lead or engagement face of the connector, to the keyway slot 48, open along the length of the lead section 41 and forming part of the boundary of the connector lead face itself. It will be understood that the present connector body 37 also departs from the CEE-22 type connector by the elimination of the grounding contact designated 52 in FIG. 3.

The present connector body 37 is attached to the electrical appliance 10 by properly orienting its end face 42 with the receptacle cavity 23 so that the keyway 38 is aligned with the dummy blade 32 and the recesses designated 53, associated with the contactor blades 39, are aligned with the receptacle blades 27. Once aligned, the connector 37 is pushed forwardly into cavity 23 causing the blades 27 to enter the recesses 53 and frictionally engage the contactor blades 39 to establish electrical contact. The connector body 37 is releasably retained in the receptacle cavity 23 by frictional forces developed by mating surfaces of these parts.

Figure 4:
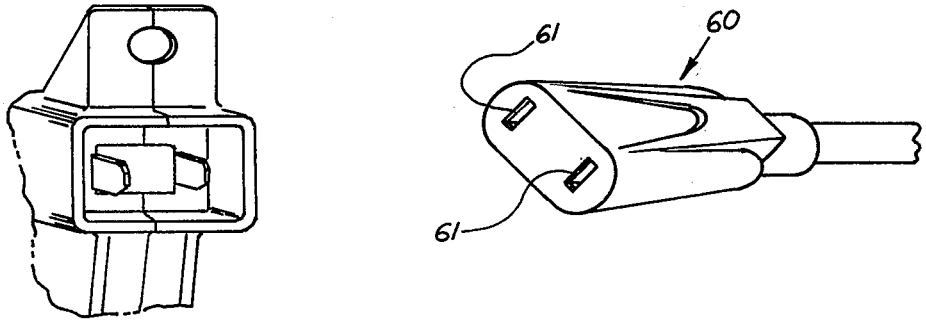
(PRIOR ART) Fig 4
FIG. 4 is a partial perspective view of an appliance receptacle and a mating cord set in another form of the prior art.

The disclosed combination of the appliance receptacle 22 and detachable cord set 36 has the desirable capacity to discourage use of commonly available replacement cords which frequently have insufficient amperage rating and/or questionable structural integrity. More specifically, the disclosed receptacle and connector combination is incompatible with the standard two-prong connector 60 depicted in FIG. 4, currently in ordinary use in the United States for ungrounded and/or double-insulated applications. This incompatibility relies on several differences including electrical blade size and spacing relative to recesses 61 in the standard U.S. connector 60 and, importantly, interference between the dummy blade 32 and the body of this connector 60.

The disclosed combination of receptacle 22 and connector 37 also precludes use of the standard European connector 71 of FIG. 3 because of interference developed by the dummy blade 32 and the body of this connector. The dummy blade 32 thus discriminates against connectors not provided with the keyway 48 of the present connector 37.

It can be understood, however, that the receptacle and connector combination of the invention has the important advantage of sharing overall size, general configuration and certain individual components with the European standard connector 71. For example, the housing 11 of the electrical appliance 10 as well as the foot switch housing 18 may be substantially identical as between that incorporating the present invention and a European CEE-22 arrangement. Further, the electrical blades 27 may be substantially identical to that used in the European design. In a European receptacle such as illustrated at 76 in FIG. 3, an electrically conducting blade 77 of conventional size and placement replaces the dummy blade 32. The interchangeability of various parts of the housings 11 and 18 is important from a manufacturing standpoint, since this feature substantially reduces tooling and inventory costs.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A detachable cord set in combination with an electrical appliance such as an electric vacuum cleaner having a housing, a receptacle on the housing, the receptacle including a cavity, a pair of flat electrical blades spaced from one another in parallel planes within the cavity and adapted to cooperate with means in the housing for connecting them to an electrical load in the housing, a flat discriminator blade in said cavity in a plane midway between said electrical blades, the cord set having at one end a connector for electrically energizing said electrical blades, said connector having an engagement end face, said end face having a pair of recesses adapted to receive said electrical blades, said recesses being narrow rectangular formations aligned with spaced parallel planes, said connector including internal contactors associated with each of said recesses and adapted to contact said electridal blades, a forward section of said connector being receivable in said cavity, said forward section being substantially a prismatic projection of the perimetric profile of said end face, said connector end face profile including two mutually opposed straight long sides and two mutually opposed short sides, the corners joining one long side to the short sides being beveled, the corners joining the opposite long side to the two short sides being rounded, said end face being substantially the same as that of the standard European connector type CEE-22 but with the central grounding contact recess being replaced by a narrow rectangular keyway, said keyway extending through the mid-zone of the one long side, the plane of the keyway being generally parallel to the recesses and in a plane midway between them, the keyway extending laterally into and beyond a plane common to said recesses, said flat discriminator blade of said receptacle being adapted to slide longitudinally into said keyway when the connector is inserted into said cavity, said discriminator blade with the connector inserted in the cavity extending laterally outward of the plane of the side of the connector associated with said keyway.

2. The combination set forth in claim 1, wherein said discriminator blade is integrally formed with an insulator element extending across substantially the full distance between said electrical blades.

3. A detachable cord set for an electrical appliance having a receptacle with a geometrically coded cavity, the cord set including at one end a connector body for reception into the cavity, the connector body having a lead end face defining a perimetric profile complementary to the cavity with only one orientation acceptable thereto, a lead section of the connector body having a length at least generally equal to the depth of the cavity, the exterior of the lead section being defined by a generally prismatic projection of said lead end face profile, said lead end face profile including two mutually opposed straight long sides and two mutually opposed short sides, the corners joining one long side to the short sides being beveled, the corners joining the opposite long side to the two short sides being rounded, said end face being substantially the same as that of the standard European connector type CEE-22 but with the central grounding contact recess being replaced by a narrow rectangular keyway, said keyway extending through the mid-zone of the one long side, said end face being interrupted by a pair of recesses of relatively narrow rectangular form, the recesses being symmetrically spaced on opposite sides of the plane of said keyway and being in parallel alignment therewith, the keyway extending laterally inward from its associated long side into a plane common to said recesses, and an electrical contactor associated with each of said recesses within the body of the connector.

* * * * *